US012735812B2

(12) United States Patent
Nakamichi et al.

(10) Patent No.: US 12,735,812 B2
(45) Date of Patent: Sep. 15, 2026

(54) WOVEN/KNITTED FABRIC AND GARMENT CONTAINING SAME

(71) Applicant: Toray Industries, Inc., Tokyo (JP)

(72) Inventors: Shinya Nakamichi, Otsu (JP); Kojiro Inada, Otsu (JP)

(73) Assignee: Toray Industries, Inc., Tokyo (JP)

( * ) Notice: Subject to any disclaimer, the term of this patent is extended or adjusted under 35 U.S.C. 154(b) by 634 days.

(21) Appl. No.: 18/013,981

(22) PCT Filed: May 26, 2021

(86) PCT No.: PCT/JP2021/019944

§ 371 (c)(1),
(2) Date: Dec. 30, 2022

(87) PCT Pub. No.: WO2022/018960

PCT Pub. Date: Jan. 27, 2022

(65) Prior Publication Data

US 2023/0287604 A1 Sep. 14, 2023

(30) Foreign Application Priority Data

Jul. 20, 2020 (JP) ..... 2020-123451

(51) Int. Cl.
*D01F 8/12* (2006.01)
*D01D 5/34* (2006.01)
(Continued)

(52) U.S. Cl.
CPC ..... *D01F 8/12* (2013.01); *D01D 5/34* (2013.01); *D02G 1/02* (2013.01); *D03D 15/283* (2021.01);
(Continued)

(58) Field of Classification Search
None
See application file for complete search history.

(56) References Cited

U.S. PATENT DOCUMENTS

2017/0145602 A1 5/2017 Dugan
2017/0167061 A1 6/2017 Date et al.
(Continued)

FOREIGN PATENT DOCUMENTS

CN 110088365 A 8/2019
CN 110799681 A 2/2020
(Continued)

OTHER PUBLICATIONS

International Search Report and Written Opinion for International Application No. PCT/JP2021/019944, dated Aug. 10, 2021, 6 pages.
(Continued)

*Primary Examiner* — Marla D Mcconnell
*Assistant Examiner* — Kevin Worrell
(74) *Attorney, Agent, or Firm* — Buchanan Ingersoll & Rooney PC

(57) ABSTRACT

Objects of the present invention are to provide a woven/knitted fabric that does not inhibit movement of the body and that has excellent wearing feel, and is particularly suitable for use in garments, as well as garments using the woven/knitted fabric. Provided is a woven/knitted fabric at least partially including a false-twist yarn composed of an eccentric sheath-core type polyamide composite fiber having an equilibrium moisture content of 6.3% or less, the woven/knitted fabric having a stress ratio at 15% elongation in the warp direction to the weft direction of from 0.25 to 2.0.

7 Claims, 1 Drawing Sheet

(51) Int. Cl.

| | |
|---|---|
| ***D02G 1/02*** | (2006.01) |
| ***D03D 15/283*** | (2021.01) |
| ***D03D 15/44*** | (2021.01) |
| ***D03D 15/49*** | (2021.01) |
| ***D03D 15/56*** | (2021.01) |
| *A41D 31/10* | (2019.01) |

(52) U.S. Cl.
CPC ..... *D03D 15/44* (2021.01); *D03D 15/56* (2021.01); *A41D 31/10* (2019.02); *D03D 15/49* (2021.01); *D10B 2331/02* (2013.01)

(56) References Cited

U.S. PATENT DOCUMENTS

| | | | | |
|---|---|---|---|---|
| 2018/0327933 | A1* | 11/2018 | Sato | D04B 21/16 |
| 2020/0087820 | A1 | 3/2020 | Suzuki et al. | |

FOREIGN PATENT DOCUMENTS

| | | | | |
|---|---|---|---|---|
| EP | 3 643 817 | A1 | | 4/2020 |
| JP | 2001159030 | A | * | 6/2001 |
| JP | 2002-030525 | A | | 1/2002 |
| JP | 2002285449 | A | | 10/2002 |
| JP | 2003129361 | A | | 5/2003 |
| JP | 2007197890 | A | * | 8/2007 |
| JP | 2018003190 | A | | 1/2018 |
| WO | 2015129735 | A1 | | 9/2015 |
| WO | 2017221713 | A1 | | 12/2017 |

OTHER PUBLICATIONS

Office Action (Notification of the First Office Action) issued Jun. 20, 2024, by the National Intellectual Property Administration, P. R. China in corresponding Chinese Patent Application No. 202180049133.6 and an English translation of the Office Action. (12 pages).

* cited by examiner

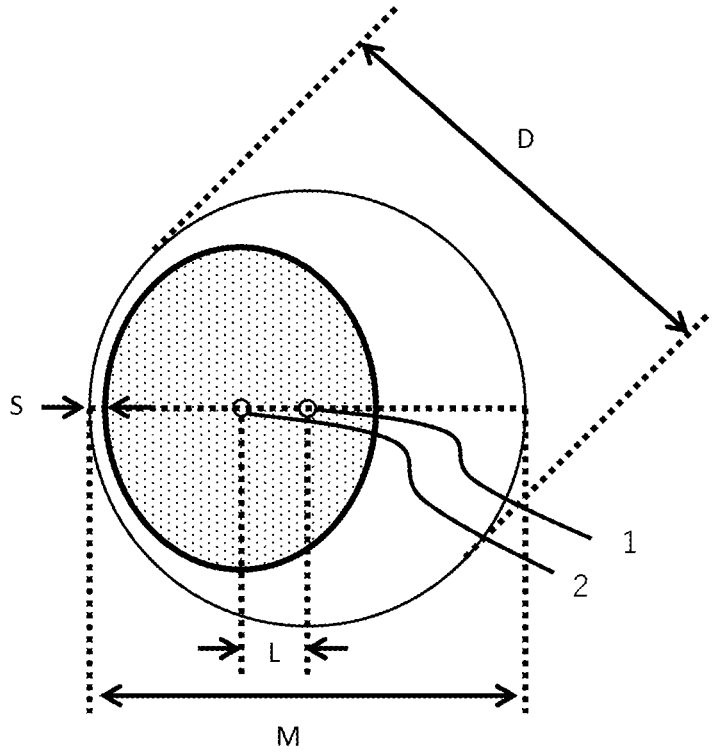
D
S
1
2
L
M

WOVEN/KNITTED FABRIC AND GARMENT CONTAINING SAME

CROSS REFERENCE TO RELATED APPLICATIONS

This application is the U.S. National Phase application of PCT/JP2021/019944 filed May 26, 2021 which claims priority to Japanese Patent Application No. 2020-123451, filed Jul. 20, 2020, the disclosures of these applications being incorporated herein by reference in their entireties.

FIELD OF THE INVENTION

The present invention relates to woven/knitted fabrics comprising a polyamide composite fiber, and garments containing the same.

BACKGROUND OF THE INVENTION

Conventionally, polyester fibers for clothing have been imparted with stretch properties so that they do not inhibit body movements in order to improve the wearing feel. In addition, polyamide fibers are softer and better in touch than polyester fibers, and have been widely used for clothing. Nylon 6, nylon 66, and the like that are typical polyamide fibers for clothing, have almost no stretch properties because of being single-fiber yarns composed of a single polymer, and thus are subjected to false-twisting or the like to impart stretch properties before being used for woven or knitted fabrics. However, it has been difficult to obtain a woven or knitted fabric that has sufficiently satisfying stretch properties from such single-fiber yarns that are processed by false-twisting or the like.

Thus, it has been suggested that potentially crimping polyamide multifilament yarns having different relative viscosities are twisted in order to obtain woven fabrics having stretch properties (for example, see Patent Literature 1). In addition, a woven or knitted fabric having high stretch properties even in products that have passed through dyeing processes, by means of the textured yarns composed of fibers containing low water-absorbing polyamide (for example, see Patent Literature 2) has been proposed. Furthermore, woven/knitted fabrics have been proposed that can develop crimps and exhibit high stretch properties when subjected to wet or dry heat treatment under high tension in the warp direction, by means of highly heat-shrinkable polyamide composite fiber containing amorphous polyamide or finished yarns made of the fiber (for example, see Patent Literature 3).

PATENT LITERATURE

Patent Literature 1: JP 2002-285449 A
Patent Literature 2: WO 2015/129735
Patent Literature 3: WO 2017/221713

SUMMARY OF THE INVENTION

However, none of the methods disclosed in Patent Literatures 1 to 3 can be said to provide a woven or knitted fabric suitable for use in garments, that does not inhibit body movements and has excellent wearing feel.

For example, woven fabrics composed of a polyamide composite fiber described in Patent Literature 1 have had difficulties in satisfactorily achieving both surface quality without wrinkles and stretch properties. In general, polyamide fiber woven/knitted fabrics are likely to have wrinkles, which is unique to polyamide fibers, developed during wet-heat processes for scouring or dyeing. Once such wrinkles occur, it is difficult to remove them even by dry-heat process for heat-setting. Thus, to maintain the quality, processing is done while applying a tension in wet-heat processes. However, in that case, crimps that are expected to be developed in gray yarns or finished yarns cannot be sufficiently developed, resulting in woven/knitted fabrics with poor stretch properties.

On the other hand, textured yarns composed of a fiber containing a low water-absorbing polyamide as disclosed in Patent Literature 2 could have improved stretch properties while preventing development of wrinkles. However, they are still insufficient for obtaining such garments that do not inhibit complex body movements and has excellent wearing feel while maintaining the quality.

Highly heat-shrinkable polyamide composite fibers described in Patent Literature 3 could shrink due to a stress exceeding the binding force of the woven or knitted fabric and provide high shrinking properties. However, similarly as described above, they are still insufficient for obtaining such garments that do not inhibit complex body movements and has excellent wearing feel. It is noted that amorphous polyamide polymers will experience advance of moisture absorption crystallization over time, and thus their shrinking properties are difficult to be controlled, which leads to, as a result of advanced crystallization, woven/knitted fabrics with poor stretch properties.

Thus, objects of the present invention aim to solve the problems described above and are specifically to provide a woven/knitted fabric that does not inhibit movement of the body and has excellent wearing feel, and is particularly suitable for use in garments, as well as garments using the woven/knitted fabric.

The woven/knitted fabric of the present invention at least partially comprises a false-twist yarn composed of an eccentric sheath-core type polyamide composite fiber having an equilibrium moisture content of 6.3% or less, the woven/knitted fabric having a stress ratio at 15% elongation in the warp direction to the weft direction of from 0.25 to 2.0.

In a preferred embodiment of the present invention, the woven/knitted fabric according to the aspect described above is provided, wherein the moisture content of the polyamide constituting the sheath component in the polyamide composite fiber is 4.00% by mass or less.

In a preferred embodiment of the present invention, the woven/knitted fabric according to the aspects described above is provided, wherein the viscosity ratio of the polyamide constituting the core component to the polyamide constituting the sheath component in the polyamide composite fiber is from 1.20 to 1.40.

In a preferred embodiment of the present invention, the woven/knitted fabric according to the aspects described above is provided, wherein in a cross section of the polyamide composite fiber, the ratio (S/D) of the minimum thickness of the sheath component (S) to the fiber diameter (D) is from 0.010 to 0.100, and the ratio (L/M) of the distance (L) between the center of gravity of the composite fiber (CG) and the center of gravity of the core component (CGcore) to the length (M) of a cross section of the fiber cut along the line joining the CG and the CGcore is from 0.125 to 0.333.

In a preferred embodiment of the present invention, the woven/knitted fabric according to the aspects described above is provided, wherein the polyamide mainly constituting the sheath component is nylon 610, and the polyamide mainly constituting the core component is nylon 6 or nylon 66 in the polyamide composite fiber.

In a preferred embodiment of the present invention, the woven/knitted fabric according to the aspects described above further comprises a resin layer.

In a preferred embodiment of the present invention, a garment at least partially comprising the woven/knitted fabric according to the aspects described above is provided.

Advantageous Effects of Invention

According to the present invention, woven/knitted fabrics that are excellent in quality, and excellent in wearing feel because of no inhibition of body movements in a complex way as well as in specific directions, and that are particularly suitable for use in garments, and garments using them can be obtained.

BRIEF DESCRIPTION OF DRAWINGS

The FIGURE is an exemplary schematic cross-sectional view of the eccentric sheath-core type polyamide composite fiber according to the present invention.

DETAILED DESCRIPTION OF EMBODIMENTS OF THE INVENTION

The woven/knitted fabric of the present invention at least partially comprises an eccentric sheath-core type polyamide composite fiber having an equilibrium moisture content of 6.3% or less.

The eccentric sheath-core type polyamide composite fiber refers to a composite fiber in which at least two types of polyamides form an eccentric sheath-core structure. The term "eccentric" as used herein means that the position of the center of gravity of the polyamide constituting the core component is different from the center of the cross section of the composite fiber in the cross section of the polyamide composite fiber. As specifically illustrated in the FIGURE, the center of gravity 1 of the polyamide composite fiber (CG) and the center of gravity 2 of the core component (CGcore) are in different positions. The term "sheath-core" means a state where polyamide that is a core component (hereinafter may be referred to as "first polyamide") is covered with polyamide that is a sheath component (hereinafter may be referred to as "second polyamide") or the like. The present invention uses an eccentric sheath-core type composite fiber rather than side-by-side type composite fiber rather to achieve excellent quality. Different polyamide than the first and second polyamides may be contained as long as the first polyamide is covered without impairing the effects of the present invention. Polyamide that is crystalline is preferable because it improves the quality stability. Crystalline polyamide is polyamide that forms crystals and has a melting point, and is a polymer in which so-called hydrocarbon groups are linked to a main chain via amide bonds. Examples of the crystalline polyamide include polycaproamide, polyhexamethylene adipamide, polyhexamethylene sebacamide, polytetramethylene adipamide, and a condensation polymerization type polyamide of 1,4-cyclohexanebis and a linear aliphatic dicarboxylic acid, and copolymers thereof and mixtures thereof. However, it is preferable to use a homopolyamide from the viewpoint of easy reproduction of a uniform system and stable exhibition of functions.

The first polyamide is a different type of polyamide from the second polyamide described below, and examples thereof include nylon 6, nylon 66, nylon 4, nylon 610, nylon 11, nylon 12, and copolymers containing these as main components. The first polyamide may contain components besides lactams, aminocarboxylic acids, diamines, and dicarboxylic acids in the repeating structure thereof as long as the effects of the present invention are not inhibited. However, those other than elastomers containing polyol or the like in the repeating structure are preferably used from the viewpoint of the yarn production properties and the strength.

From the viewpoint of the yarn production properties, the strength, and the peeling resistance, the first polyamide is preferably a polymer in which a content of a single lactam, aminocarboxylic acid, or a combination of a diamine and a dicarboxylic acid in the repeating structure is 90% or more, and more preferably 95% or more. Such a component is preferably mainly nylon 66 or nylon 6, more preferably nylon 66, nylon 6, or a copolymer thereof, still more preferably nylon 6 or a copolymer thereof, from the viewpoint of thermal stability. Nylon 6 or a copolymer thereof has a melting point near that of the second polyamide described below, allowing for more stable melt spinning.

The second polyamide is obtained by, for example, combining a diamine unit and a dicarboxylic acid unit containing a sebacic acid unit as a main component. In particular, mainly nylon 610, or nylon 610 or a copolymer thereof is most preferably used, in view of stable polymerizability and less yellowing of textured yarns, excellent stretch properties of the woven/knitted fabrics, and good dyeability. Here, sebacic acid can be produced by refining seeds for castor oil, and is regarded as a plant-derived raw material, and is used in preferred embodiments.

Examples of dicarboxylic acid constituting other dicarboxylic acid units than sebacic acid units include oxalic acid, malonic acid, succinic acid, glutaric acid, adipic acid, pimelic acid, suberic acid, azelaic acid, phthalic acid, isophthalic acid, and terephthalic acid, and these may be contained without impairing the effects of the present invention. These dicarboxylic acids are also preferably plant-derived dicarboxylic acids. The copolymerization amount of the other dicarboxylic acid units than the sebacic acid units is preferably 0 to 40 mol %, more preferably 0 to 20 mol %, and still more preferably 0 to 10 mol %, based on all the dicarboxylic acid units.

Examples of diamines constituting the diamine units include diamines having 2 or more carbon atoms, and diamines having 4 to 12 carbon atoms are preferable. Specifically, examples thereof include putrescine, 1,5-pentanediamine, hexamethylenediamine, trimethylenediamine, nonanediamine, methylpentanediamine, phenylenediamine, and ethambutol. These diamines are also preferably plant-derived diamines.

A composite ratio of the polyamides (first polyamide: second polyamide) is preferably within a range of 6:4 to 4:6 (mass ratio). When the mass ratio is within a range of 6:4 to 4:6, the equilibrium moisture content of the polyamide composite fiber according to the present invention can be controlled to 6.3% or less, and the obtained woven/knitted fabric is provided with excellent stretch properties.

If necessary, a pigment, a heat stabilizer, an antioxidant, a weathering agent, a flame retardant, a plasticizer, a release agent, a lubricant, a foaming agent, an antistatic agent, a moldability improver, a reinforcing agent, and the like may be added and blended for use.

The polyamide composite fiber according to the present invention has an equilibrium moisture content of 6.3% or less under a condition of a temperature being 30° C., a relative humidity being 90 RH %, and a treatment time being 72 hours. The equilibrium moisture content as used herein is one measured in accordance with JIS L 1013 8.2 (2010). When the equilibrium moisture content is 6.3% or less, the swelling of the polyamide fiber under a wet heat condition of a scouring step and a dyeing step is reduced, resulting in reduced elongation as well as reduced wrinkles and embossments of the woven/knitted fabric. This allows woven/knitted fabrics to pass through scouring, dyeing, and other steps without applying extra tension, resulting in woven and knitted fabrics with excellent elasticity, resulting in obtaining woven/knitted fabrics having excellent stretch properties. The equilibrium moisture content is preferably 6.0% or less. The lower limit value of the equilibrium moisture content cannot be specified and the smaller the better, and is 1.0% in practice. Methods of allowing the equilibrium moisture content to be within the range according to the present invention comprise, for example, using polyamides that give equilibrium moisture content within the range according to the present invention to obtain composite fibers.

A polyamide composite fiber according to the present invention, the moisture content of the second polyamide constituting the sheath is preferably 4.00% by mass or less, and more preferably 3.50% by mass or less. The lower limit value cannot be specified, and is 1.00% by mass or more in practice. Furthermore, the moisture content of the second polyamide that is positioned on the sheath side is preferably lower than the moisture content of the polyamide composite fiber according to the present invention, and more preferably lower than that of the first polyamide that is the core component. Thus, swelling due to heat and moisture that is unique to polyamide can be further prevented. In addition, products that have passed through the dyeing step can also obtain further improved stretch properties. The moisture content is measured using a sample after being subjected to the conditions at a temperature of 23° C. and a relative humidity of 90 RH % for a treatment period of 72 hours according to JIS L 7251 (2002) A. Measurements were performed by using only the sheath component obtained by separating the core and sheath portions of the eccentric sheath-core type composite fiber, or when the sheath component can be identified, by using the same material. Methods of allowing the moisture content to be within the range according to the present invention include, for example, those comprising stretching and heat-setting the second polyamide as illustrated above during spinning or false twist processes for crystallization.

In the polyamide composite fiber according to the present invention, the viscosity ratio of polyamide constituting the core component to polyamide constituting the sheath component, that is, the value obtained by dividing the viscosity of polyamide having the highest viscosity among the polyamides to be combined whether it is the core component or the sheath component by the viscosity of polyamide having the lowest viscosity is preferably 1.03 or more, and more preferably 1.20 or more. The viscosity ratio is preferably 1.40 or less. Selection of polyamide that allows the viscosity ratio to be within the range results in development of difference in shrinkage after the heat treatment, which lead to stronger crimping and improved stretch properties of the woven/knitted fabric.

In the cross section of the polyamide composite fiber according to the present invention, the ratio (S/D) of the minimum thickness of the sheath component (S) and the fiber diameter (D) is preferably from 0.010 to 0.100. When the ratio is 0.100 or less, the shrinkage difference between polymers is less likely to be inhibited and furthermore the stretch properties are excellent. When the ratio is 0.010 or more, excellent wear resistance and stability against cracking due to reduction of the amount are obtained. S/D is more preferably 0.020 or more. S/D is also more preferably 0.030 or less.

In the cross section of the polyamide composite fiber according to the present invention, the ratio (L/M) between the distance (L) between the center of gravity of the composite fiber (CG) and the center of gravity of the core component (CGcore) and the length (M) of a cross section of the fiber cut along the line joining the CG and the CGcore is from 0.125 to 0.333. When L/M is 0.125 or more, crimps are further developed depending on the differential shrinkage between the polymers, resulting in better stretch properties. When L/M is 0.333 or less, the stability when forming the cross section of the composite fiber is excellent. L/M is more preferably 0.200 or more. In accordance with the present invention, both the preferred S/D and L/M values according to the present invention are more preferably satisfied at the same time.

In accordance with the present invention, when an eccentric sheath-core type polyamide composite fiber having an equilibrium moisture content of 6.3% or less is made into a false-twist yarn, the impact of swelling is further reduced, and the effects as a false-twist yarn can be exerted. When the equilibrium moisture content is over 6.3%, or when the fiber is a composite but side-by-side composite fiber, the expected effects such as stretch properties are not obtained due to swelling during the processes or the like even when being false-twisted. A twisted yarn commonly used in side-by-side composite fibers may be contained without impairing the effects of the present invention, but is combined with caution as twisted yarns tend to be inferior in quality, texture, and stretch properties to false-twist yarns.

The woven/knitted fabric of the present invention preferably at least partially comprise a false-twist yarn composed of the eccentric sheath-core type polyamide composite fiber according to the present invention. For example, in the case of woven fabrics, in order to further improve the stretch properties of the woven fabric, the mixture ratio of the polyamide composite fiber in the false-twist yarn constituting at least one of warps and wefts is preferably 50% or more, more preferably 80% or more, and still more preferably 100%. Similarly, in the case of knitted fabrics, a part of the constituent yarns are preferably false-twist yarns made of the polyamide composite fiber. In order to further improve the stretch properties of the knitted fabric, the mixture ratio of the polyamide composite fiber according to the present invention in the false-twist yarn constituting one side or both sides of the knitted fabric is preferably 50% or more, more preferably 80% or more, and still more preferably 100%. The mixture ratio of the polyamide composite fiber is determined according to JIS L 1030-2 (2012). Note that false-twist yarns have a cross section that is deformed due to convergence in a heated state during false twisting, and thus can be identified by observing the cross section of the fiber.

The stretch elongation ratio of the false-twist yarn composed of the polyamide composite fiber is preferably 150% or more, and more preferably 170% or more. Use of a false-twist yarn composed of the polyamide composite fiber having excellent stretch elongation ratio enables obtaining a woven/knitted fabric that has excellent stretch properties in the warp direction, which is difficult to be achieved in woven/knitted fabrics using conventional polyamide fibers, and that can have controlled elongation stress in the warp direction and further have good surface quality. In order to achieve excellent stretch properties especially in the warp direction of the woven/knitted fabric, the twist multiplier K at the time of false-twisting [(K=(number of twisting: T/m)×{(fineness: dtex)×0.9}^(½)] is preferably from 25,000 to 35,000, and particularly preferably from 31,000 to 35,000.

The total fineness of the polyamide composite fiber in the false-twist yarn is preferably from 5 dtex to 300 dtex, and more preferably from 10 dtex to 200 dtex. When the total fineness is within the range described above, the woven/knitted fabric has excellent strength while achieving comfortable wearing feel.

The single yarn fineness is preferably 5.0 dtex or less, and more preferably 2.5 dtex or less. The lower limit of the single yarn fineness is not particularly limited, but substantially is 0.7 dtex. When the single yarn fineness is within such a range, a woven/knitted fabric that has excellent flexibility is obtained.

The woven/knitted fabric of the present invention may use fibers in addition to the false-twist yarn composed of the polyamide composite fiber as described above without impairing the effects of the present invention. In such a case, the stretch elongation ratio is preferably 50% or more, and more preferably 70% or more. Use of the composite fiber used in the present invention for warps and of a false twisted textured yarn composed of a single-component fiber for wefts allows the elongation stress ratio according to the present invention to be easily obtained, as well as allows for excellent texture and surface quality, and thus is a preferred embodiment for applications that permit lower stretch properties. The material used for the single-component fiber is not particularly limited, and is preferably an expansion yarn composed of a polyamide fiber or a cationic dye-dyeable polyester fiber, or an expansion yarn composed of a polyurethane fiber covered with a polyamide fiber, a cationic dye-dyeable polyester fiber, various natural fibers or semi-synthetic fibers, from the viewpoint of color fastness and stretch properties. An expansion yarn composed of a polyamide fiber is more preferable because of excellent surface quality.

The woven/knitted fabric of the present invention has a stress ratio at 15% elongation in the warp direction to the weft direction of the woven/knitted fabric, that is, a value obtained by dividing the stress in the warp direction by the stress in the weft direction, of from 0.25 to 2.0. The strass ratio is preferably 0.4 or more, and more preferably 0.5 or more. The strass ratio is also preferably 1.5 or less, and more preferably 1.0 or less. To obtain a garment that does not inhibit body movements and is excellent in wearing feel, high stretch properties only either in the warp or weft direction of the woven fabric used are insufficient, and may constitute a constraint on the part of garments where the fabric is used. Furthermore, even the case where both stretch properties are high may not result in garments with excellent wearing feel. To obtain garments having excellent wearing feel using polyamide fiber woven/knitted fabrics, the stress at 15% elongation that is considered as being linked with skin movements is important rather than the stretch properties of the woven/knitted fabric used. By the stress at 15% elongation is affected the comfort to wear of garments, and thus even if the stretch properties are high but if the stress at 15% elongation is high, it is difficult to obtain garments with good comfort to wear. In addition, the stress ratio in the warp direction to the weft direction is important. When the stress ratio is less than 0.25 or more than 2.0, discomfort occurs. The polyamide composite fiber according to the present invention is also effective to achieve such a stress ratio. That is, a false-twist yarn composed of the polyamide composite fiber as described above according to the present invention makes it possible to control the stretch properties. Preferably, the amount thereof used or the density of woven/knitted fabrics can be controlled to obtain the stress ratio according to the present invention. In addition, tension control in the manufacturing process such as the dyeing step to allow longitudinally and transversely well-balanced crimps to be developed in the step as described below is also an effective means. The use of false-twist yarns composed of the polyamide composite fiber according to the present invention at least as warps as described above is a preferred embodiment in that the stress ratio according to the present invention can be easily adjusted.

The weave of a woven/knitted fabric is not limited, and in the case of a woven fabric, the weave thereof may be any of a plain weave, a twill weave, a sateen weave, a modified weave thereof, and a mixed weave thereof depending on the intended application. For weaves that make a woven fabric with a firm texture, a plain weave with many restraint points, or a ripstop weave obtained by combing plain weave, flat cords, and mat weave is preferred. To obtain woven fabrics with bulging texture and excellent stretch properties, twill weaves with appropriate restraint points are preferred. In the case of a knitted fabric, the weave thereof may be any of plain weave of a circular knitted fabric, interlock weave, half weave of a warp knitted fabric, satin weave, jacquard weave, modified weaves thereof, and mixed weaves thereof depending on the intended application, and a half weave of a single tricot knitted fabric or the like is preferred from the viewpoint that the knitted fabric is thin and stable, and has excellent stretch properties.

In preferred embodiments of the present invention, the woven/knitted fabric density is controlled as described above because the stress ratio according to the present invention can be easily adjusted. In the case of a woven fabric, the ratio of the cover factors CF [CF=density (number/2.54 cm)×(fineness (dtex)×0.9)^(½)] of the warps and wefts (warp CF/weft CF) is from 0.8 to 2.0, and preferably from 1.0 to 1.7. In the case of a knitted fabric, the ratio of the density of the warps and wefts (wale/course) is preferably from 0.7 to 2.5.

In the woven fabric of the present invention, use of the composite fiber used in the present invention for both warps and wefts in addition to controlling the cover factor invention is preferable because an elongation ratio of over 20% in both the warp and weft directions of the woven fabric is easily achieved. In the present invention, the elongation ratio of woven/knitted fabrics is preferably over 20% in both the warp and weft directions, and more preferably 23% or more. The upper limit is not particularly limited, and is usually 90% or less. For elongation ratios in the present invention, values obtained in the methods described in Examples are used.

In preferred embodiments, the woven/knitted fabric of the present invention has a resin layer, which can improve the wind-blocking and waterproof performance. In general, inclusion of a resin layer tends to deteriorate the wearing feel. However, in the present invention, the woven/knitted fabric composed of the polyamide composite fiber as described above can provide a garment having excellent wearing feel. Therefore, the woven/knitted fabric provided with a resin layer to add functionality is a preferred embodiment. A resin layer is a layer of resin on one or both sides of a woven or knitted fabric, which may be partially porous as long as it is continuous in shape. A resin layer may also have a multi-layered structure. The resin may be selected as appropriate depending on the function to be imparted from, for example but not particularly limited to, polyurethane, polytetrafluoroethylene, polyester, acryl, and polycarbonate. In addition, the resin may optionally contain various additives from the viewpoint of functions, texture, and the like. In a preferred embodiment, the resin is polyurethane from the viewpoint of affinity with polyamide.

Next, an example of the method for manufacturing the woven/knitted fabric of the present invention will be described.

For melt spinning of the polyamide composite fiber, production methods by high-speed direct spinning will first be described below as an example. To achieve an equilibrium moisture content or a viscosity ratio within the range according to the present invention, a first polyamide as the core component and a second polyamide as the sheath component are preferably selected as appropriate with reference to the equilibrium moisture content or the viscosity of single-component polyamide fibers. The selected first polyamide and second polyamide are separately melted, weighed and transported using a gear pump for direct formation of a composite flow so that a sheath-core structure is formed by a normal method, followed by ejection from a spinneret for eccentric sheath-core type composite fibers. During that time, in order to obtain a desired composite fiber cross section, the flow path and the cross section of ejected polymers are controlled by the spinneret. The ejected polyamide composite fiber yarns are cooled to reach a temperature of 30° C. by being blown with cooling air by means of a yarn cooling device such as chimney, and coated with oil by an oil supply device while being converged. Then, the yarns are drawn by a drawing roller at 1,500 to 4,000 m/min, and allowed to pass through the drawing roller and a stretching roller. At that time, the yarns are stretched at 1.0 to 3.0 times depending on the ratio of the circumferential speed of the drawing roller to that of the stretching roller. The yarns are heat-set by a stretching roller and are wound into a package at a winding rate of 3,000 m/min or more. In addition, a method for producing a polyamide composite fiber by high-speed direct spinning of the melt spinning will be described below as an example. The first and second polyamides are separately melted, weighed and transported using a gear pump for direct formation of a composite flow so that a sheath-core structure is formed by a normal method, followed by ejection from a spinneret using the spinneret for eccentric sheath-core type composite fibers. The ejected polyamide composite fiber yarns are cooled to reach a temperature of 30° C. by being blown with cooling air by means of a yarn cooling device such as chimney, and coated with oil by an oil supply device while being converged. Then, the yarns are drawn by a drawing roller at 3,000 to 4,500 m/min, and allowed to pass through the drawing roller and a stretching roller to stretch the yarns at 1.0 to 1.2 times depending on the ratio of the circumferential speed of the drawing roller to that of the stretching roller. Further, the yarns are wound into a package at a winding rate of 3,000 m/min or more.

In particular, the spinning temperature is appropriately set based on the melting point of the polyamide with high viscosity. When the spinning temperature is higher, the crystalline portion tends to increase, and the equilibrium moisture content tends to decrease. When the spinning temperature is lower, the mobile amorphous fraction tends to increase, and the rigid amorphous fraction tends to decrease slightly. Therefore, the spinning temperature is preferably from 35° C. to 70° C. that is higher than the melting point of the polyamide, and more preferably from 45° C. to 60° C. By setting the spinning temperature appropriately, the equilibrium moisture content of the polyamide composite fiber used in the present invention and the rigid amorphous fraction that affect the equilibrium moisture content can be controlled, and a desired thermal shrinkage stress and a desired stretch elongation ratio can be obtained.

Generally, in the case of side-by-side composite cross section, the difference in flow velocity tends to cause yarn bending, which deteriorates the operability. An eccentric sheath-core type composite cross section improves the yarn production properties, and single-yarn fine size products can be easily obtained.

Appropriate designing of draft stretching (drawing rate) can also control the equilibrium moisture content of the polyamide composite fiber. A high drawing rate tends to cause higher crystalline properties and lower equilibrium moisture content, while a low drawing rate tends to cause lower crystalline properties and higher equilibrium moisture content. In addition, the rigid amorphous fraction is increased, and the thermal shrinkage stress and the stretch elongation ratio is improved. The drawing rate is preferably from 1,500 to 4,000 m/min.

In the case of obtaining stretched yarns, thermal stretching using the drawing roller as a heating roller may also capable of decreasing the equilibrium moisture content of the polyamide composite fiber used in the present invention. In addition, the rigid amorphous fraction is increased, and the thermal shrinkage stress is improved. The stretching ratio is preferably from 1.5 to 3.0 times, and more preferably from 2.0 to 3.0 times. The thermal stretching temperature is preferably from 30° C. to 90° C., and more preferably from 40° C. to 60° C. In addition, heat-setting using the stretching roller as a heating roller, the thermal shrinkage stress of the polyamide composite fiber can be appropriately designed. The heat-setting temperature is preferably from 130° C. to 180° C.

In addition, the entanglement may also be provided by using a known entanglement apparatus in and before the winding step. If necessary, the number of entanglements may also be increased by applying entanglements multiple times. Furthermore, an oil agent may also be additionally applied immediately before winding. The method of producing the false-twist yarn is not particularly limited, and for example, it is preferable to perform false twisting by using a pin type, a friction type, a belt type or the like depending on the fineness and the number of twists.

The woven/knitted fabric of the present invention can be woven and knitted according to a known method, which is not particularly limited.

The stress ratio of the woven/knitted fabric of the present invention is preferably adjusted and controlled by the dyeing step to be within the range according to the present invention. The tensile strength is especially controlled in the dyeing step that frequently uses water, hot water, and steam. When the tensile strength in the warp or weft direction is high, occurrence of fiber crimps in the woven/knitted structure is prevented in the direction with higher tension applied, and the stress at 15% elongation tends to be higher. In the dyeing step for the woven/knitted fabric, a polyamide fiber is generally processed with a relatively large tensile force applied thereto, because it swells with water or the like to reduce the quality, such as wrinkles, or deteriorate the process passability. In accordance with the present invention, use of a false-twist yarn composed of an eccentric sheath-core type polyamide composite fiber in the woven/knitted fabric can prevent reduction of the quality, such as wrinkles, and deterioration of the process passability. In addition, the tensile strength can be controlled to achieve a stress ratio in the range according to the present invention.

A controlled dyeing step allows sufficient crimps to be developed after the dyeing step to give high stretch properties.

In the present invention, a resin layer can be formed by laminate or coating processing. Since the stretch properties of the woven/knitted fabric may be reduced in the laminate or coating processing, selection of the laminating agent or coating agent to be used, reduction of the tensile strength, methods comprising partially coating instead of coating, or the like can be used as appropriate.

The woven/knitted fabric of the present invention can be used taking advantage of its stretch properties in various applications, such as garments, beddings, bags, sheets, gloves, floor mats, and surface materials. Among them, a garment that is excellent in wearing feel because of no inhibition of body movements can be obtained by allowing the garment to at least partially comprise the woven/knitted fabric of the present invention, because of its excellent stretch properties and excellent longitudinal and transverse elongation balance.

The garment of the present invention at least partially comprises the above-described woven/knitted fabric of the present invention. The applications of the garment are not limited, and include sportswear, casual wear, and women's and men's clothing, represented by down jackets, windbreakers, golf wear, rainwear, yoga wear. In particular, the garment can be suitably used for sportswear and down jackets.

EXAMPLES

Next, the woven/knitted fabric of the present invention will be described in detail with reference to Examples.

A. Viscosity and Viscosity Ratio

A polyamide chip sample in an amount of 0.25 g was dissolved in 25 mL of sulfuric acid having a concentration of 98 mass % to reach a concentration of 1 g/100 ml, followed by measurement of the efflux time (T1) using Ostwald viscometer at 25° C. Subsequently, the efflux time (T2) for sulfuric acid having a concentration of 98 mass % alone was measured. The sulfuric acid relative viscosity, defined as the ratio of T1 to T2, that is, T1/T2, was determined and considered as the viscosity in the present invention. The value obtained by dividing the largest value of the viscosities of the polyamides to be combined by the smallest value was considered as the viscosity ratio in the present invention. The viscosity and viscosity ratio were both determined to the second decimal place, with the third decimal place rounded off.

B. Equilibrium Moisture Content

The equilibrium moisture content was measured based on the mass after treatment in an absolute dry condition and under the conditions at a temperature of 30° C. and a relative humidity of 90% RH for 72 hours according to JIS L 1013 8.2 (2010).

C. Moisture Content

The moisture content was measured using a sample after being subjected to the conditions at a temperature of 23° C. and a relative humidity of 90 RH % for a treatment period of 72 hours according to JIS L 7251 A (2002).

D. Minimum Thickness of Sheath Component (S) and Fiber Diameter (D), and Ratio Thereof (S/D)

Multifilaments composed of composite fibers were embedded with an embedding agent such as epoxy resin in 10 consecutive locations at 1 cm intervals in the fiber axial direction to obtain samples. Images of the samples were taken with a transmission electron microscope (TEM) at a magnification that allowed for observation of 10 or more fibers. In this case, metal dyeing is applied to clarify the contrast at the junction of the core component and the sheath component. Using an image analysis software "WinROOF2015" produced by Mitani Corporation, the fiber diameters D of all the single yarns in the observed image, and the minimum thickness of the sheath component S were measured. Note that when the cross section of the fiber was out of round, the fiber diameter in the same direction of the minimum thickness S was defined as D. The average values of the minimum thicknesses S and of the fiber diameters D of all fibers that can be observed in the images from 10 samples were determined, and sets of the average fiber diameter D and the average minimum thickness S of the samples were collected, which were further averaged to obtain the fiber diameter D and the minimum thickness S according to the present invention. The fiber diameter D and the minimum thickness S were measured to the fourth decimal place in μm. The averages were determined to the third decimal place by rounding off the fourth decimal place. The ratio (S/D) of the minimum thickness S and the fiber diameter D thus obtained was rounded to the third decimal place by rounding off the fourth decimal place.

E. Distance (L) Between Center of Gravity of Composite Fiber (CG) and Center of Gravity of Core Component (CGcore), Length (M) of Cross Section of Fiber Cut Along the Line Joining CG and CGcore, and Ratio (L/M)

In the images taken at the 10 locations in Section D, the distance (L) between the center of gravity (CG) and the center of gravity of the core component (CGcore) of each of all the composite fibers in the observed image was measured using an image analysis software "WinROOF2015" produced by Mitani Corporation. Thereafter, the length M of a cross section of the fiber cut along the line obtained by extending L was measured. In such a manner, the average values of the distances L and of the lengths M of all fibers that can be observed in the images from 10 samples were determined, and 10 sets of the average distance L between the centers of gravity and the average length M of a cross section of the fiber of the samples were collected, which were further averaged to obtain the distance L between the centers of gravity, and the length M of a cross section of the fiber according to the present invention. The distance L and the length M were measured to the fourth decimal place in μm. The averages were determined to the third decimal place by rounding off the fourth decimal place. The ratio L/M was rounded to the third decimal place by rounding off the fourth decimal place.

F. Total Fineness

The method was according to JIS L 1013 8.3 A (2010). The fiber sample was wound at a tension of 1/30 (g)× estimated fineness (dtex) to prepare a skein having a yarn length according to the JIS regulations, and the total fineness of the fiber yarns was calculated. The measurement was performed five times, and the average value was defined as the total fineness.

G. Stretch Elongation Ratio

The method was according to JIS L 1013 8.11C (2010). The fiber sample was taken out in a skein form, immersed in boiling water at a temperature of 90° C. for 20 minutes, air-dried, subjected to a load of 0.176 mN/tex for 30 seconds to determine the length A, and then subjected to a load of 8.82 mN/tex for 30 seconds to determine the length B. Then, calculation was made according to the following formula:

$$\text{Stretch elongation ratio (\%)}=[(B-A)/A]\times 100.$$

H. Elongation Ratio of Woven/Knitted Fabric

The method was according to JIS L 1096 8.16.1 A (2010). The elongation ratio was measured using a tensile tester by preparing test pieces having widths of 50 mm×300 mm in the warp and weft directions, respectively, from the samples obtained in Examples and Comparative Examples, and stretching the test pieces with 14.7 N at a tensile rate of 200 mm/min in the measurement direction at a grip interval of 200 mm.

I. Stress at 15% Elongation and Stress Ratio at 15% Elongation

A test piece of 50 mm longitude×50 mm latitude was elongated in the warp and weft directions at the same time at a rate of 3 mm/sec, where the initial load was a load (N) (up to the value of integer place) equivalent to gravity applied to a length of 1 m by the width of the test piece, using a small-size biaxial tensile tester ("Pf-002" manufactured by Kato Tech Co., Ltd.) under an environment at a temperature of 20° C. and a relative humidity of 65% RH, and the stresses at 15% elongation both in the warp and weft directions of the woven/knitted fabric were measured. The stress ratio at 15% elongation in the warp direction to the weft direction was obtained by dividing the stress in the warp direction by the stress in the weft direction. Measurements were performed five times using different test pieces, and the average value was rounded to two decimal places to obtain the stress at 15% elongation (N/cm) and the stress ratio at 15% elongation.

J. Texture

The texture of woven fabrics was evaluated in the following five levels based on the tactile sensations of five skilled and experienced persons, with the average of each person's evaluation score rounded off to one decimal place. The texture was considered good when the evaluation was 3 or more points.

5 points: Excellent
4 points: Very good
3 points: Good
2 points: Poor
1 point: Very poor K. Surface Quality The surface quality of woven fabrics was evaluated in the following five levels based on visual inspection by five skilled and experienced persons, with the average of each person's evaluation score rounded off to one decimal place. The surface quality was considered good when the evaluation was 3 or more points.

5 points: Excellent
4 points: Very good
3 points: Good
2 points: Poor
1 point: Very poor L. Wearing Comfort Garments with long sleeves and long trousers were prepared using the woven/knitted fabrics obtained in Examples. The wearing comfort was evaluated in the following five levels based on wearing evaluation by five skilled and experienced persons, with the average of each person's evaluation score rounded off to one decimal place. The wearing comfort was considered good when the evaluation was 3 or more points.

5 points: Excellent
4 points: Very good
3 points: Good
2 points: Poor
1 point: Very poor Fibers used in Examples and Comparative Examples will be described.

Manufacturing Example 1

Nylon 6 (viscosity: 2.63) as a crystalline polyamide (A) and nylon 610 (viscosity: 2.71) as a crystalline polyamide (B) were melted separately, and then ejected in a melted manner (spinning temperature: 270° C.) at a composite ratio (mass ratio) of the crystalline polyamide (A) to the crystalline polyamide (B) of 5:5 using a spinneret for eccentric sheath-core type composite fibers (12 holes, round holes), with the crystalline polyamide (A) positioned as the sheath. The yarns ejected from the spinneret were cooled and solidified by a yarn cooling device, coated with a hydrous oil agent by an oil supply device, entangled by a fluid entangling nozzle device, followed by being drawn at 3700 m/min with a drawing roller (room temperature: 25° C.) and being stretched by 1.1 times with a stretching roller (room temperature: 25° C.), and then wound into a package at a winding rate of 4000 m/min. Further, the obtained polyamide composite fiber was subjected to false-twisting by using a pin false-twisting machine at a heater temperature of 170° C. and a twist multiplier at the time of false-twisting of K=33000 to obtain a false-twist yarn having a total fineness of 78 dtex and a filament number of 12. The properties of the obtained false-twist yarn are shown in Table 1.

Manufacturing Example 2

A false-twist yarn was obtained in the same manner as in Manufacturing Example 1, except that the crystalline polyamide (B) was nylon 510. The properties of the obtained false-twist yarn are shown in Table 1.

Manufacturing Example 3

A false-twist yarn was obtained in the same manner as in Manufacturing Example 1, except that the sheath in the cross section of the eccentric sheath-core yarn was changed to nylon 610 (viscosity: 2.71), and the core was changed to nylon 6 (viscosity: 2.63). The properties of the obtained false-twist yarn are shown in Table 1.

Manufacturing Examples 4 and 5

A false-twist yarn was obtained in the same manner as in Manufacturing Example 3, except that the crystalline polyamide (A) was changed to nylon 6 (viscosity: 3.32) in Manufacturing Example 4, and to nylon 6/66 copolymer (viscosity: 3.65) in Manufacturing Example 5. The properties of the obtained false-twist yarn are shown in Table 1.

Manufacturing Examples 6 and 7

A false-twist yarn with modulated morphology of the cross section of the eccentric sheath-core was obtained in the same manner as in Manufacturing Example 4, except that S/L and L/M were changed by changing the spinneret for eccentric sheath-core type composite fibers. The properties of the obtained false-twist yarn are shown in Table 1.

Manufacturing Example 8

A false-twist yarn with a total fineness of 56 dtex and a filament number of 24 was obtained in the same manner as in Manufacturing Example 4, except that the spinneret was changed to one with (24 holes and round holes) to adjust the melt ejection rate. The properties of the obtained false-twist yarn are shown in Table 1.

Manufacturing Example 9

A false-twist yarn was obtained in the same manner as in Manufacturing Example 4, except that the crystalline polyamide (B) was changed to nylon 6 (viscosity 2.63). The properties of the obtained false-twist yarn are shown in Table 1.

Manufacturing Example 10

Nylon 6 (viscosity: 2.63) was melted, and ejected in a melted manner (spinning temperature: 270° C.) using a spinneret (24 holes, round holes). The yarns ejected from the spinneret were cooled and solidified by a yarn cooling device, coated with a hydrous oil agent by an oil supply device, entangled by a fluid entangling nozzle device, followed by being drawn at 3700 m/min with a drawing roller (room temperature: 25° C.) and being stretched by 1.1 times with a stretching roller (room temperature: 25° C.), and then wound into a package at a winding rate of 4000 m/min. Further, the obtained polyamide composite fiber was subjected to false-twisting by using a pin false-twisting machine at a heater temperature of 190° C. and a twist multiplier at the time of false-twisting of K=32000 to obtain a false-twist yarn having a total fineness of 56 dtex and a filament number of 24. The properties of the obtained false-twist yarn are shown in Table 1.

Manufacturing Example 11

A false-twist yarn was obtained in the same manner as in Manufacturing Example 10, except that the twist multiplier at the time of false-twisting of K=23000. The properties of the obtained false-twist yarn are shown in Table 1.

Manufacturing Example 12

A false-twist yarn was obtained in the same manner as in Manufacturing Example 1, except that the spinneret was changed to obtain a side-by-side composite fiber. The properties of the obtained false-twist yarn are shown in Table 1.

Manufacturing Example 13

Nylon 6 (viscosity: 3.32) as a crystalline polyamide (A) and nylon 610 (viscosity: 2.71) as a crystalline polyamide (B) were melted separately, and then ejected in a melted manner (spinning temperature: 270° C.) at a composite ratio (mass ratio) of the crystalline polyamide (A) to the crystalline polyamide (B) of 5:5 using a spinneret for eccentric sheath-core type composite fibers (12 holes, round holes), with the crystalline polyamide (B) positioned as the sheath. The yarns ejected from the spinneret were cooled and solidified by a yarn cooling device, coated with a hydrous oil agent by an oil supply device, entangled by a fluid entangling nozzle device, followed by being drawn at 3700 m/min with a drawing roller (room temperature: 25° C.) and being stretched by 1.2 times with a stretching roller (room temperature: 25° C.), and then wound into a package at a winding rate of 4500 m/min. Further, the obtained polyamide composite fiber was subjected to yarn-twisting at a twist multiplier of K=4000 to obtain a twisted yarn having a total fineness of 78 dtex and a filament number of 12. The properties of the obtained twisted yarn are shown in Table 1.

Example 1

A plain woven fabric was prepared using the yarn of Manufacturing Example 1 as both warp and weft yarns, and subjected to scouring and dyeing processes by way of liquid jet scouring and jet dyeing. Dry-heat setting before and after the dyeing was appropriately adjusted. Thus, a product was obtained that had excellent longitudinal and transverse elongation balance and excellent wearing comfort, with the finished density being warp density=125/2.54 cm and weft density=92/2.54 cm. The properties of the obtained product are shown in Table 2.

Example 2

In the same manner as in Example 1 except that both the warp and weft yarns used were of Manufacturing Example 2, a product was obtained that had excellent longitudinal and transverse elongation balance and excellent wearing comfort, with the finished density being warp density=123/2.54 cm and weft density=90/2.54 cm. The properties of the obtained product are shown in Table 2.

Example 3

In the same manner as in Example 1 except that both the warp and weft yarns used were of Manufacturing Example 3, a product was obtained that had excellent longitudinal and transverse elongation balance and also had excellent surface quality, with the finished density being warp density=130/2.54 cm and weft density=95/2.54 cm. The properties of the obtained product are shown in Table 2.

Example 4

In the same manner as in Example 1 except that both the warp and weft yarns used were of Manufacturing Example 4, a product was obtained that had a finished density of warp density=135/2.54 cm, and weft density=98/2.54 cm. The obtained product had a firm texture, excellent longitudinal and transverse elongation balance and excellent surface quality, and further had excellent elongation ratio. The properties of the obtained product are shown in Table 2.

Examples 5 and 6

In the same manner as in Example 4 except that the density of the gray fabric was appropriately adjusted, a product was obtained that had a finished density of warp density=148/2.54 cm and weft density=68/2.54 cm in Example 5, while a product was obtained that had excellent longitudinal and transverse elongation balance and had a finished density of warp density=102/2.54 cm, and weft density=122/2.54 cm in Example 6. The properties of the obtained product are shown in Table 2.

Example 7

In the same manner as in Example 4 except that the weft yarn was of Manufacturing Example 10, a product was obtained that had excellent longitudinal and transverse elongation balance, with the finished density being warp density=120/2.54 cm and weft density=115/2.54 cm. The properties of the obtained product are shown in Table 2.

Example 8

In the same manner as in Example 4 except that the fabric weave was 2/1 twill, and the density of the gray fabric was appropriately adjusted, a product was obtained with warp density=166/2.54 cm and weft density=117/2.54 cm. The obtained product had a soft texture, and had excellent longitudinal and transverse elongation balance. The properties of the obtained product are shown in Table 2.

Example 9

In the same manner as in Example 4 except that both the warp and weft yarns used were of Manufacturing Example 5, a product was obtained that had a finished density of warp density=138/2.54 cm, and weft density=101/2.54 cm. The obtained product had a firm texture, excellent longitudinal and transverse elongation balance and excellent surface quality, and further had excellent elongation ratio. The properties of the obtained product are shown in Table 2.

Examples 10 and 11

In the same manner as in Example 4 except that both the warp and weft yarns used were of Manufacturing Example 6 in Example 10, and of Manufacturing Example 7 in Example 11, products were obtained that had a finished density of warp density=130/2.54 cm and weft density=98/2.54 cm in Example 10, and of warp density=120/2.54 cm, and weft density=88/2.54 cm in Example 11. The obtained product had excellent longitudinal and transverse elongation balance.

Example 12

In the same manner as in Example 4 except that both the warp and weft yarns used were of Manufacturing Example 8, and that the density of the gray fabric was appropriately adjusted, a product was obtained that had a finished density of warp density=149/2.54 cm and weft density=119/2.54 cm. The obtained product had excellent longitudinal and transverse elongation balance and also was excellent especially in texture. The properties of the obtained product are shown in Table 2.

Example 13

A urethane-based two-part reactive adhesive was applied to a nonporous moisture-permeable polyurethane film in a form of dots of 1 mm in diameter by using a gravure roller. Separately, water repellent finishing was performed on the product obtained in Example 4, and lamination was performed by facing and laminating the adhesive-coated surface of the polyurethane film described above and the back surface of the woven fabric. The obtained product had excellent longitudinal and transverse elongation balance and also was excellent especially in the water repellent properties and water proofing properties. The properties of the obtained product are shown in Table 2.

Comparative Example 1

Scouring and dyeing in the same manner as in Example 1 except that both the warp and weft yarns used were of Manufacturing Example 9 resulted in occurrence of strong wrinkles and reduced surface quality. Thus, finishing setting by applying a high tensile force was then performed to obtain a product that had a finished density of warp density=128/2.54 cm and weft density=81/2.54 cm. The obtained product had poor longitudinal and transverse elongation balance. The properties of the obtained product are shown in Table 3.

Comparative Example 2

In the same manner as in Example 7 except that the weft yarn was of Manufacturing Example 11, a product was obtained that had a finished density of warp density=113/2.54 cm and weft density=115/2.54 cm. The obtained product showed lower elongation properties in the weft direction and had poor longitudinal and transverse elongation balance. The properties of the obtained product are shown in Table 3.

Comparative Example 3

In the same manner as in Example 1 except that both the warp and weft yarns used were of Manufacturing Example 12, a product was obtained that had a finished density of warp density=122/2.54 cm, and weft density=90/2.54 cm. The obtained product had insufficient surface quality. The properties of the obtained product are shown in Table 3.

Comparative Example 4

In the same manner as in Example 1 except that both the warp and weft yarns used were of Manufacturing Example 13, and that the density of the gray fabric was appropriately adjusted, a product was obtained that had a finished density of warp density=177/2.54 cm and weft density=88/2.54 cm. The obtained product showed lower elongation properties in the warp direction and had poor longitudinal and transverse elongation balance. The properties of the obtained product are shown in Table 3.

Comparative Examples 5 and 6

In the same manner as in Example 4 except that the density of the gray fabric was appropriately adjusted, a product was obtained that had a finished density of warp density=173/2.54 cm and weft density=68/2.54 cm in Comparative Example 5, while a product was obtained that had a finished density of warp density=95/2.54 cm, and weft density=127/2.54 cm in Comparative Example 6. The obtained products showed lower elongation properties in the weft direction for Comparative Example 5 and lower elongation properties in the warp direction for Comparative Example 6, and both had poor longitudinal and transverse elongation balance. The properties of the obtained product are shown in Table 3.

Comparative Example 7

Using the same gray fabric as Example 1, it was scoured with an open soaper that applies tension in the warp direction, followed by dyeing by jet dyeing. Finishing setting was performed in the same manner as in Example 1 to obtain a product having a finished density of warp density=122/2.54 cm and weft density=81/2.54 cm. The obtained product showed lower elongation properties in the warp direction and had poor longitudinal and transverse elongation balance. The properties of the obtained product are shown in Table 3.

Example 14

Using the yarn of Manufacturing Example 4 for both the front side and the back side, a half tricot knitted fabric was prepared. The obtained knitted fabric was subjected to the same method as in Example 1 to obtain a product of 60 wale/2.54 cm and 76 course/2.54 cm that had excellent longitudinal and transverse elongation balance. The properties of the obtained product are shown in Table 4.

Comparative Example 8

In the same manner as in Example 12 except that the density of the gray fabric was appropriately adjusted, a product of 53 wale/2.54 cm and 92 course/2.54 cm was obtained. The obtained product had poor longitudinal and transverse elongation balance. The properties of the obtained product are shown in Table 4.

TABLE 1

| | | Mfg. Ex. 1 | Mfg. Ex. 2 | Mfg. Ex. 3 | Mfg. Ex. 4 | Mfg. Ex. 5 | Mfg. Ex. 6 |
|---|---|---|---|---|---|---|---|
| Crystalline polyamide (A) | Composition | nylon 6 | nylon 6 | nylon 6 | nylon 6 | nylon 6/66 copolymer | nylon 6 |
| | Viscosity | 2.63 | 2.63 | 2.63 | 3.32 | 3.65 | 3.32 |
| | Moisture content | 7.80% | 7.80% | 7.80% | 7.80% | 8.10% | 7.80% |
| Crystalline polyamide (B) | Composition | nylon 610 | nylon 510 | nylon 610 | nylon 610 | nylon 610 | nylon 610 |
| | Viscosity | 2.71 | 2.83 | 2.71 | 2.71 | 2.71 | 2.71 |
| | Moisture content | 3.30% | 3.70% | 3.30% | 3.30% | 3.30% | 3.30% |
| Equilibrium moisture content | | 5.7% | 5.9% | 5.7% | 5.7% | 5.8% | 5.7% |
| Composite form | | eccentric sheath-core | eccentric sheath-core | eccentric sheath-core | eccentric sheath-core | eccentric sheath-core | eccentric sheath-core |
| S/D | | 0.022 | 0.022 | 0.022 | 0.022 | 0.022 | 0.037 |
| L/M | | 0.230 | 0.230 | 0.230 | 0.230 | 0.230 | 0.150 |
| Sheath polymer | | polymer A | polymer A | polymer B | polymer B | polymer B | polymer B |
| Composite ratio (polymer A/B) | | 5:5 | 5:5 | 5:5 | 5:5 | 5:5 | 5:5 |
| Viscosity ratio | | 1.03 | 1.08 | 1.03 | 1.23 | 1.35 | 1.35 |
| Total fineness (dtex) | | 78 | 78 | 78 | 78 | 78 | 78 |
| Filament number | | 12 | 12 | 12 | 12 | 12 | 12 |
| Twist multiplier at the time of false-twisting (K) | | 33000 | 33000 | 33000 | 33000 | 33000 | 33000 |
| Stretch elongation ratio (%) | | 182 | 191 | 182 | 201 | 215 | 192 |
| Twist multiplier of twisted yarn (K) | | 0 | 0 | 0 | 0 | 0 | 0 |

| | | Mfg. Ex. 7 | Mfg. Ex. 8 | Mfg. Ex. 9 | Mfg. Ex. 10 | Mfg Ex. 11 | Mfg. Ex. 12 | Mfg. Ex. 13 |
|---|---|---|---|---|---|---|---|---|
| Crystalline polyamide (A) | Composition | nylon 6 | nylon 6 | nylon 6 | nylon 6 | nylon 6 | nylon 6 | nylon 6 |
| | Viscosity | 3.32 | 3.32 | 3.32 | 2.63 | 2.63 | 2.63 | 3.32 |
| | Moisture content | 7.80% | 7.80% | 7.80% | 7.80% | 7.80% | 7.80% | 7.80% |
| Crystalline polyamide (B) | Composition | nylon 610 | nylon 610 | nylon 6 | / | / | nylon 610 | nylon 610 |
| | Viscosity | 2.71 | 2.71 | 2.63 | / | / | 2.71 | 2.71 |
| | Moisture content | 3.30% | 3.30% | 7.80% | / | / | 3.30% | 3.30% |
| Equilibrium moisture content | | 5.7% | 5.7% | 7.7% | 7.7% | 7.7% | 5.7% | 5.7% |
| Composite form | | eccentric sheath-core | eccentric sheath-core | eccentric sheath-core | / | / | side-by-side | eccentric sheath-core |
| S/D | | 0.200 | 0.022 | 0.022 | / | / | / | 0.022 |
| L/M | | 0.100 | 0.230 | 0.230 | / | / | 0.250 | 0.230 |
| Sheath polymer | | polymer B | polymer B | polymer B | / | / | / | polymer B |
| Composite ratio (polymer A/B) | | 5:5 | 5:5 | 5:5 | / | / | 5:5 | 5:5 |
| Viscosity ratio | | 1.35 | 1.23 | 1.26 | / | / | 1.03 | 1.23 |
| Total fineness (dtex) | | 78 | 56 | 78 | 56 | 56 | 78 | 78 |
| Filament number | | 12 | 24 | 2 | 24 | 24 | 12 | 12 |
| Twist multiplier at the time of false-twisting (K) | | 33000 | 33000 | 33000 | 32000 | 23000 | 33000 | 0 |
| Stretch elongation ratio (%) | | 150 | 200 | 195 | 82 | 42 | 190 | 40 |
| Twist multiplier of twisted yarn (K) | | 0 | 0 | 0 | 0 | 0 | 0 | 4000 |

TABLE 2

| | | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 |
|---|---|---|---|---|---|---|---|---|---|---|---|---|---|---|
| Warp | | Mfg. Ex. 1 | Mfg. Ex. 2 | Mfg. Ex. 3 | Mfg. Ex. 4 | Mfg. Ex. 4 | Mfg. Ex. 4 | Mfg. Ex. 4 | Mfg. Ex. 4 | Mfg. Ex. 5 | Mfg. Ex. 6 | Mfg. Ex. 7 | Mfg. Ex. 8 | Mfg. Ex. 4 |
| Weft | | Mfg. Ex. 1 | Mfg. Ex. 2 | Mfg. Ex. 3 | Mfg. Ex. 4 | Mfg. Ex. 4 | Mfg. Ex. 4 | Mfg. Ex. 10 | Mfg. Ex. 4 | Mfg. Ex. 5 | Mfg. Ex. 6 | Mfg. Ex. 7 | Mfg. Ex. 8 | Mfg. Ex. 4 |
| Fineness (dtex) | Warp | 78 | 78 | 78 | 78 | 78 | 78 | 78 | 78 | 78 | 78 | 78 | 56 | 78 |
| | Weft | 78 | 78 | 78 | 78 | 78 | 78 | 56 | 78 | 78 | 78 | 78 | 56 | 78 |
| Wweave | | plain | plain | plain | plain | plain | plain | plain | 2/1twill | plain | plain | plain | plain | plain |
| Dinished density (number/ 2.54 cm) | Warp | 125 | 123 | 130 | 135 | 148 | 102 | 120 | 166 | 138 | 130 | 120 | 149 | 135 |
| | Weft | 92 | 90 | 95 | 98 | 68 | 122 | 115 | 117 | 101 | 98 | 88 | 119 | 98 |
| Cover factor ratio (warp/weft) | | 1.35 | 1.37 | 1.38 | 1.38 | 2.17 | 0.84 | 1.23 | 1.42 | 1.37 | 1.33 | 1.38 | 1.25 | 1.38 |
| Fabric elongation ratio (%) | Warp | 32 | 28 | 35 | 40 | 42 | 28 | 32 | 46 | 44 | 36 | 25 | 40 | 40 |
| | Weft | 25 | 23 | 27 | 35 | 23 | 27 | 20 | 38 | 38 | 29 | 27 | 35 | 35 |
| Stress at 15% elongation (N/cm) | Warp | 0.64 | 0.70 | 0.61 | 0.58 | 0.50 | 0.80 | 0.64 | 0.47 | 0.58 | 0.63 | 1.05 | 0.50 | 2.40 |
| | Weft | 1.05 | 1.15 | 1.01 | 0.67 | 1.30 | 0.50 | 1.54 | 0.78 | 0.73 | 0.95 | 2.10 | 0.69 | 3.70 |
| Stress ratio at 15% elongation | | 0.61 | 0.61 | 0.60 | 0.87 | 0.38 | 1.60 | 0.42 | 0.60 | 0.79 | 0.66 | 0.50 | 0.72 | 0.65 |
| Finishing | | — | — | — | — | — | — | — | — | — | — | — | — | water re-pellency + coating |
| Texture | | 4 | 4 | 4 | 4 | 4 | 4 | 4 | 4 | 4 | 4 | 4 | 5 | 4 |
| Surface quality | | 3 | 3 | 5 | 5 | 5 | 5 | 5 | 5 | 5 | 4 | 4 | 5 | 5 |
| Wearing comfort | | 5 | 5 | 5 | 5 | 4 | 4 | 5 | 5 | 5 | 5 | 3 | 5 | 5 |

TABLE 3

| | | Com. Ex. 1 | Com. Ex. 2 | Com. Ex. 3 | Com. Ex. 4 | Com. Ex. 5 | Com. Ex. 6 | Com. Ex. 7 |
|---|---|---|---|---|---|---|---|---|
| Warp | | Mfg. Ex. 9 | Mfg. Ex. 4 | Mfg. Ex. 12 | Mfg. Ex. 13 | Mfg. Ex. 4 | Mfg. Ex. 4 | Mfg. Ex. 1 |
| Weft | | Mfg. Ex. 9 | Mfg. Ex. 11 | Mfg. Ex. 12 | Mfg. Ex. 13 | Mfg. Ex. 4 | Mfg. Ex. 4 | Mfg. Ex. 1 |
| Fineness (dtex) | Warp | 78 | 78 | 78 | 78 | 78 | 78 | 78 |
| | Weft | 78 | 56 | 78 | 78 | 78 | 78 | 78 |
| Weave | | plain | plain | plain | plain | plain | plain | plain |
| Finished density | Warp | 128 | 113 | 122 | 177 | 173 | 95 | 122 |
| (number/2.54 cm) | Weft | 8 | 115 | 90 | 88 | 68 | 127 | 81 |
| Cover factor ratio (warp/weft) | | 1.59 | 1.16 | 1.36 | 2.01 | 2.54 | 0.75 | 1.52 |
| Fabric elongation ratio (%) | Warp | 15 | 35 | 26 | 17 | 36 | 15 | 15 |
| | Weft | 28 | 13 | 20 | 25 | 15 | 35 | 22 |
| Stress at 15% elongation | Warp | 3.52 | 0.64 | 0.66 | 2.20 | 0.40 | 1.30 | 3.33 |
| (N/cm) | Weft | 1.05 | 5.0 | 1.80 | 0.50 | 2.00 | 0.50 | 1.05 |
| Stress ratio at 15% elongation | | 3.35 | 0.13 | 0.37 | 4.40 | 0.20 | 2.60 | 3.17 |
| Finishing | | — | — | — | — | — | — | — |
| Texture | | 3 | 3 | 3 | 2 | 3 | 3 | 3 |
| Surface quality | | 1 | 3 | 2 | 3 | 3 | 3 | 3 |
| Wearing comfort | | 2 | 2 | 3 | 2 | 3 | 3 | 2 |

TABLE 4

| | | Ex. 14 | Com. Ex. 8 |
|---|---|---|---|
| Classification | | tricot | tricot |
| Yarns used | | front: Mfg. Ex. 4<br>back: Mfg. Ex. 4 | front: Mfg. Ex. 4<br>back: Mfg. Ex. 4 |
| Fineness (dtex) | Front | 78 | 78 |
| | Back | 78 | 78 |
| Weave | | half tricot | half tricot |
| Finished density | Wale | 60 | 53 |
| (/2.54 cm) | Course | 76 | 92 |
| Density ratio (wale/course) | | 0.79 | 0.57 |
| Knitted fabric elongation | Warp | 39 | 22 |
| ratio (%) | Weft | 63 | 90 |
| Stress at 15% elongation | Warp | 0.66 | 1.50 |
| (N/cm) | Weft | 0.70 | 0.55 |
| Stress ratio at 15% elongation | | 0.94 | 2.73 |
| Finishing | | — | — |
| Texture | | 4 | 3 |
| Surface quality | | 4 | 4 |
| Wearing comfort | | 5 | 3 |

REFERENCE SIGNS LIST

1: Center of gravity of composite fiber (CG)
2: Center of gravity of core component (CGcore)
D: Fiber diameter
S: Minimum thickness of sheath component
L: Distance between center of gravity of composite fiber (CG) and center of gravity of core component (CG core)
M: Length of cross section of fiber cut along the line joining CG and CGcore

The invention claimed is:

1. A woven or knitted fabric at least partially comprising a false-twist yarn composed of an eccentric sheath-core polyamide composite fiber where the sheath contains nylon 610 and the core contains nylon 6 or nylon 66, the fiber having an equilibrium moisture content as determined according to JIS L 1013 8.2 (2010) of 6.3% or less by mass under conditions of a temperature of 30° C. and a relative humidity of 90 RH % after a 72 hour period, the fabric also having a stress ratio of from 0.25 to 2.0 in the warp direction to the weft direction as determined according to JIS L 1096 8.16.1 A (2010) when subjected to conditions of a temperature of 20° C. and a relative humidity of 65% RH at 15% elongation, and wherein the nylon 6 or nylon 66 of the core dissolved in sulfuric acid and the nylon 610 of the sheath dissolved in sulfuric acid have a relative viscosity ratio of from 1.20 to 1.40.

2. The woven or knitted fabric according to claim 1, wherein the moisture content of the nylon 610 of the sheath is 4.00% by mass or less after being subjected to conditions of a temperature of 23° C. and a relative humidity of 90 RH % for a treatment period of 72 hours as determined according to JIS L 7251 (2002) A.

3. The woven or knitted fabric according to claim 1, wherein in a cross section of the polyamide composite fiber, the ratio (S/D) of the minimum thickness of the sheath (S) to the fiber diameter (D) is from 0.010 to 0.100, and the ratio (L/M) of the distance (L) between the center of gravity of the composite fiber (CG) and the center of gravity of the core (CGcore) to the length (M) of a cross section of the fiber cut along the line joining the CG and the CGcore is from 0.125 to 0.333.

4. The woven or knitted fabric according to claim 1, further comprising a resin layer.

5. A garment comprising the woven or knitted fabric according to claim 1.

6. The woven or knitted fabric according to claim 1, wherein the fabric is a woven fabric.

7. The woven or knitted fabric according to claim 1, wherein the fabric is a knitted fabric.

* * * * *